United States Patent [19]

Simich

[11] Patent Number: 4,509,416

[45] Date of Patent: Apr. 9, 1985

[54] BALE TIE JOINING DEVICES

[75] Inventor: Emil Simich, Chicago, Ill.

[73] Assignee: A.J. Gerrard & Company, Des Plaines, Ill.

[21] Appl. No.: 511,649

[22] Filed: Jul. 7, 1983

[51] Int. Cl.[3] ..... B65B 13/06

[52] U.S. Cl. ..... 100/25; 100/34; 140/117

[58] Field of Search ..... 100/2, 8, 25, 29, 33 R, 100/34; 140/93 A, 93.2, 116, 117, 115

[56] References Cited

U.S. PATENT DOCUMENTS

| | | | |
|---|---|---|---|
| 150,818 | 5/1874 | Brown | 100/25 X |
| 3,182,586 | 5/1965 | Armington et al. | 100/25 X |
| 3,477,363 | 11/1969 | Trumbo | 100/25 |
| 3,863,297 | 2/1975 | Simich | 100/34 X |
| 3,863,558 | 2/1975 | Trumbo | 100/34 X |
| 4,055,115 | 10/1977 | Simich et al. | 100/34 |
| 4,353,295 | 10/1982 | Kandarian | 100/8 |

*Primary Examiner*—Billy J. Wilhite

*Attorney, Agent, or Firm*—Emrich & Dithmar

[57] ABSTRACT

Bale tie joining devices for joining bale tie ends on top of a bale in a press, and wherein the completed tie joint or knot is visible to a press operator from the top before release of the bale from the press.

9 Claims, 9 Drawing Figures

BALE TIE JOINING DEVICES

BACKGROUND OF THE INVENTION

The present invention relates to bale tie joining devices and, more particularly, to bale tie joining devices which are particularly well adapted for joining bale tie ends on top of a bale.

The primary object of the present invention is to afford a novel bale tie joining device for use in bale presses, and the like, and, more particularly, to afford a novel bale tie joining device wherein the completed tie joint or knot is visible to a press operator from the top before the removal of the bale from the press.

In the past, bale ties were commonly joined on the side of the bale, as disclosed in my co-pending application for U.S. Pat. Ser. No. 376,266, filed May 10, 1982, now U.S. Pat. No. 4,438,689, and assigned to the assignee of the present invention. This has been found to be undesirable because the bale tie joint is the weakest portion of the tie and the sides of the bale expand causing greater tension on the sides of the ties.

Subsequently, joints were applied to the top of the bales. This has been found to be desirable because the tops of the bales maintain their dimensions as the bales expand upwardly.

Heretofore, in making such top joints, joiners have been installed in the top platens of presses, and in the use of such joiners, one end of the wire or tie has been hooked into the joiner at the rear of the press, with the other end of the tie passed around the bale and pushed into the joiner from the front of the press to form or splice the knot or joint on top of the bale. This system has been adapted extensively in the baling presses. However, it has several disadvantages and shortcomings, one of which is that the knotting or joining is a blind operation, the other end of the wire being inserted into a small opening and then pushed into the rear of the press into engagement with the aforementioned one end, the end portions of the tie or wire not being visible to the press operator so that he can visually ascertain whether a completed joint has been made. As will be appreciated by those skilled in the art, under such conditions, press operators have had to be highly skilled and experienced to perform tie-joining operations with a minimum of incompleted joints.

The improper or incomplete joints, heretofore known in the art in connection with the top-tie presses, were primarily due to variables in the bale tie loop geometry and the straightness of the wire between the looped ends, a cast in the wire generating sufficient torsion to twist the loop ends into improper relation relative to each other before joining. Even minor changes in the end loop geometry affect proper joining. None of these variables affected side tying, the side ties being visible to the operator at all times, and, therefore, being instantly, manually correctible before opening the press for bale ejection. As a result of these characteristics, operator experience and close tolerance with respect to bale tie wire straightness and loop geometry have heretofore been of primary importance in the proper operation of top tying bale presses. It is an important object of the present invention to eliminate such dependence on operator experience and tie wire characteristics.

Another object of the present invention is to afford a novel top tie joining device wherein the knot or joint between the two ends of the tie are readily visible to the operator before releasing the press for bale ejection.

Another objection of the present invention is to afford a joiner wherein improper or incomplete joints may be readily detected and corrected before releasing the bale, therby eliminating the need for highly experienced press operators.

A further object of the present invention is to afford a novel joiner wherein proper joints may be made even with what would otherwise be incorrect loop geometry and insufficient wire straightness.

Another object of the present invention is to afford a novel joiner of the aforementioned type wherein bale wires may be properly threaded and joined from one side of a press by a single operator.

Another object of the present invention is to afford a novel joiner of the aforementioned type which is compatible with a power feed mechanism for feeding in a plurality of wires simultaneously around the girth of a bale.

Still another object of the present invention is to afford a novel joiner of the aforementioned type which is suitable for use in high production presses.

A further object of the present invention is to afford a novel splicer or joiner of the aforementioned type which provides proper guidance of the wire ties for entry into a return chute assembly.

Another object of the present invention is to afford a novel tie joiner of the aforementioned type which is practical and efficient in operation and which may be readily and economically produced commercially.

Other and further objects of the present invention will be apparent from the following description and claims and are illustrated in the accompanying drawings which, by way of illustration, show a preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENT SHOWN HEREIN

Figure 1:
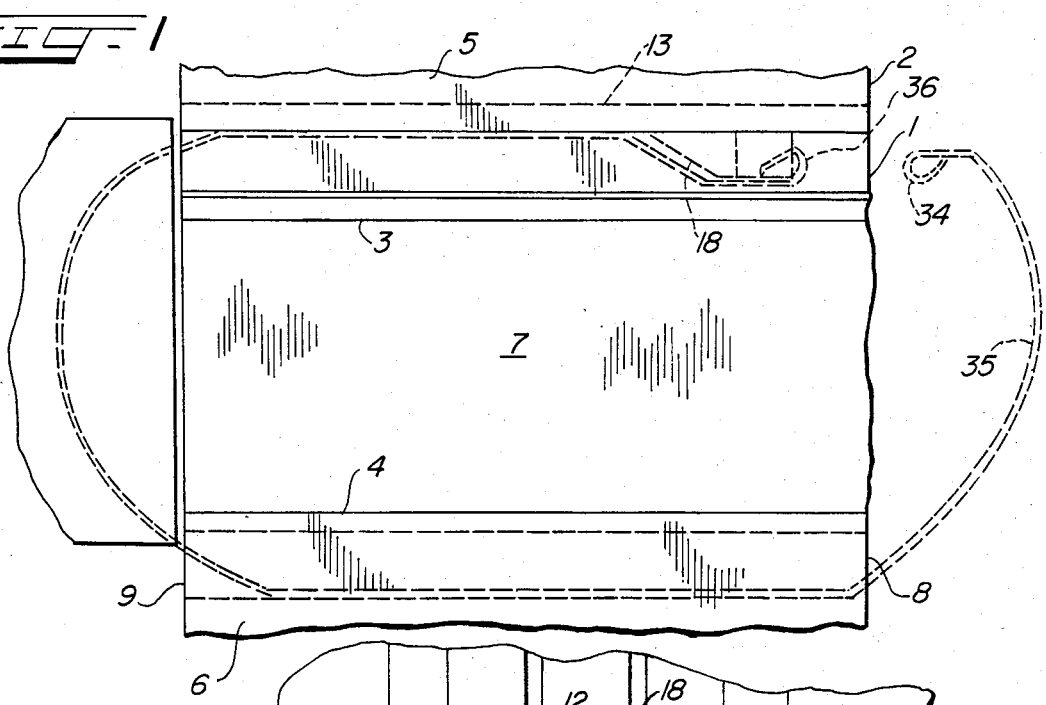
FIG. 1 is a side elevational view of a joiner embodying the principles of the present invention, showing the joiner mounted in operative position on a fiber press.

A bale tie joining device 1 embodying the principles of the present invention is shown in the drawings to illustrate the presently preferred embodiment of the present invention.

The tie splicer or joining device 1 is shown in a typical fibers press 2, such as the press shown in my aforementioned co-pending application for U.S. Pat. Ser. No. 376,266. The press 2 embodies, in general, upper platens 3 and lower platens 4 disposed between an upper follower block 5 and a lower follower block 6, and in FIG. 1, the platens 3 and 4 are shown disposed in compressing relation to each other with a pressed bale of fibers 7 disposed therebetween.

Figure 2:
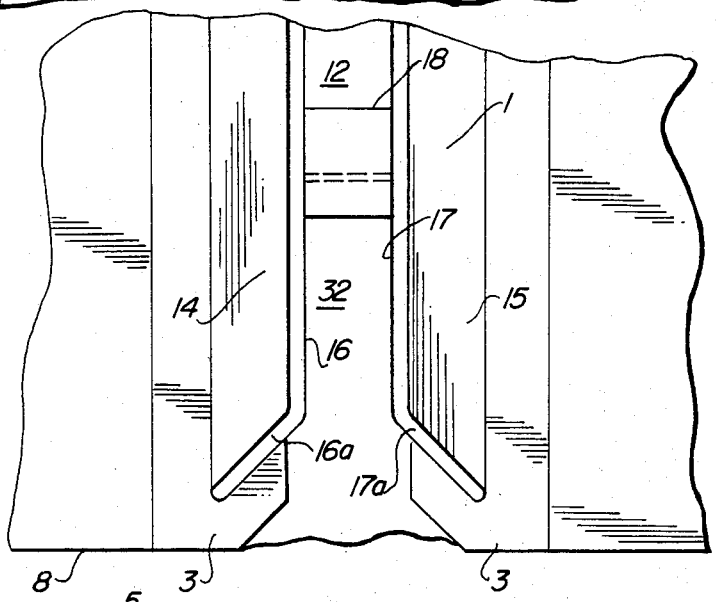
FIG. 2 is a top plan view of the joiner shown in FIG. 1.
Figure 3:
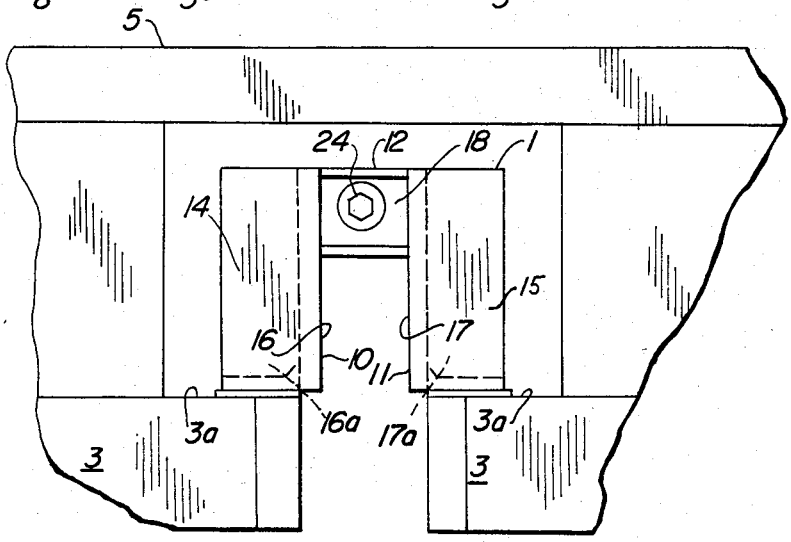
FIG. 3 is a front view of the joiner shown in FIG. 1.

The splicer or joiner 1 is substantially rectangular in shape and extends longitudinally between the front 8 and rear 9 of the press 2, of FIG. 1. The joiner 1 embodies spaced, substantially parallel, vertical sidewalls 10 and 11, and a top wall 12 extending between the upper edges of the sidewalls 10 and 11, FIG. 3. It is open at the bottom. The joiner 1 is disposed in a recess 13 in the upper follower block 5, FIG. 3, and embodies two substantially L-shaped legs 14 and 15 which respectively include upstanding sidewall portions 10 and 11 and bridge the gap between adjacent upper platens 3, FIG. 2, the inner working surfaces 16 and 17 of the angle legs 14 and 15, respectively, affording wire guides for guiding wire into and through the joiner 1. The joiner 1 is fixedly mounted to the surface 3*a* of the adjacent upper platens 3 to cooperate with the recess 13 in the upper follower block 5 and, preferably, includes inwardly sloping working surfaces 16*a* and 17*a* to facilitate insertion of the bale wire 35 into the joiner.

Figure 4:
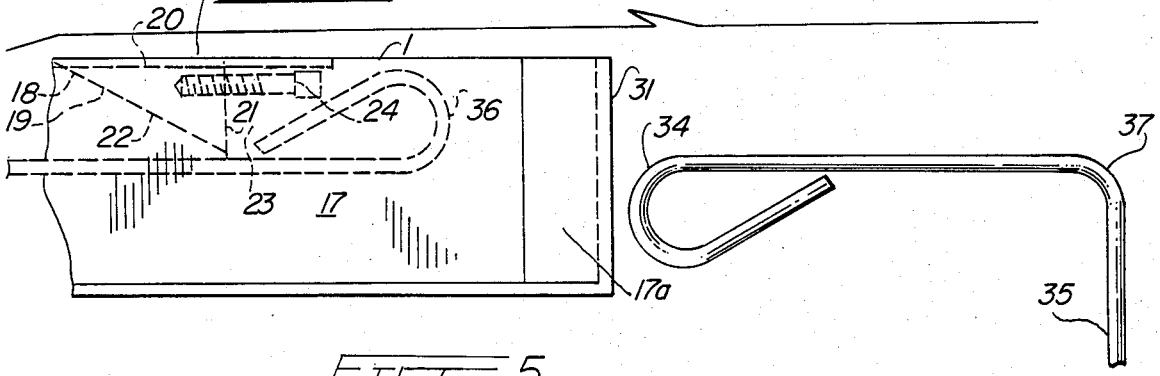
FIG. 4 is a fragmentary, detail side elevational view of the joiner shown in FIG. 1, illustrating an early step in the joining of the ends of a bale tie.
Figure 8:
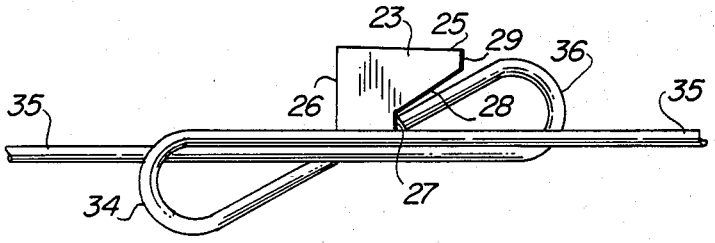
FIG. 8 is a fragmentary, detail side elevational view of a portion of the joiner shown in FIG. 7, illustrating in solid lines the position of the tie ends shown in FIG. 7.

An anchor or hook member 18 is mounted on the top wall 12 of the joiner 1 and projects downwardly therefrom, FIGS. 1 and 4. The hook member 18 embodies, as shown in FIG. 4, a substantially wedge-shaped rear portion 19 having a horizontally extending top 20, a substantially vertically extending front 21 and a bottom 22, which angles upwardly and rearwardly from the lower edge portion of the front 21 to the rear edge portion of the top 20. The rear portion 19 of the anchor 18 is secured to the side walls 10 and 11 of the joiner 1 by any suitable means such as, for example, welding, and a front portion 23 is secured to the rear portion 19 by suitable means such as a bolt 24. As also shown in FIG. 8, the front portion 23 embodies a substantially horizontally extending top 25 and a vertically extending rear 26, with a lip portion 27 projecting forwardly from the lower portion of the rear 26, and terminating in a diagonally intermediate extending front 28 disposed in rearwardly spaced relation to an upper front portion 29 of the front portion 23 of the anchor 18.

The anchor 18 is disposed in rearwardly spaced relation to the front 31 of the joiner 1, and the top wall 12 terminates at its front edge in vertical alignment with the front 29 of the anchor 18, thereby leaving a vertical opening downwardly through the joiner 1 between the working surfaces 16 and 17 of legs 14 and 15, respectively, forwardly of the top wall 12, for a purpose which will be discussed in greater detail presently.

As with respect to the bale tie apparatus disclosed in my aforementioned co-pending application for U.S. Pat. Ser. No. 376,266, the apparatus shown herein embodies a tie guide which includes the aforementioned passageway 13 extending through the upper follower block 5 and between the upper platens 3, and another passageway 33 extending through the lower follower block 6, between lower platens 4, FIG. 1, with a chute 34 extending between the passageways 13 and 33 for guiding a bale tie wire from the rear end of the passageway 13 and into the rear end of the passageway 33. However, in addition, the joiner 1 is mounted in the aforementioned passageway 13 in the apparatus shown herein, with the front 31 thereof spaced rearwardly from the front 8 of the press 2.

In the operation of the apparatus shown herein, the front end portion 34 of a bale tie wire 35 is fed rearwardly through the joiner 1 from the front end to the rear edge thereof, then downwardly through the chute 34 into the rear edge of the passageway 33, and forwardly through the passageway 33 into outwardly projecting relation to the press 2. The bale tie wire 35 is then further longitudinally advanced until the rear end loop portion 36 thereof is pulled into abutting engagement with the front face portion 30 and the lip 27, FIG. 8, of the anchor 18 in the position shown in FIGS. 1 and 4. Such longitudinal movement of the bale tie 35 through the press 2 may be effected by any suitable means, such as, for example, manually or by suitable driving mechanism, such as that shown in my aforementioned co-pending application for U.S. Pat. Ser. No. 376,266.

With the bale tie 35 thus positioned in the press 2, a substantially ninety degree bend 37 is formed by suitable means, such as, for example, manually, in the wire 35, FIG. 4, at a suitable distance, such as, for example, five inches from the leading edge of the leading end 34 of the wire 35.

Figure 5:
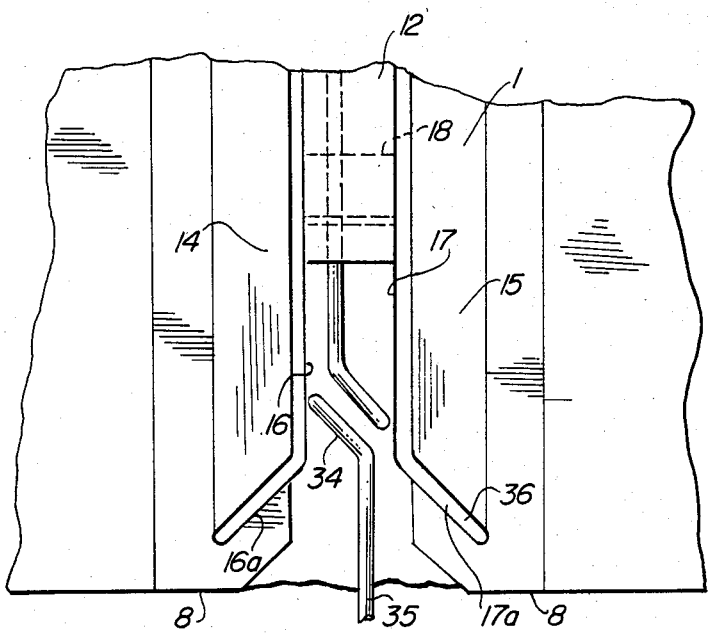
FIG. 5 is a fragmentary, detail top plan view of the joiner shown in FIG. 1, illustrating a subsequent step in the tie joining operation.

Both leading end portion 34 and the trailing end portion 36 of the wire 35 are in the form of loops, FIG. 4, which are offset from the main body portion of the wire 35 at equal, oppositely disposed angles, as shown in FIG. 5.

Figure 6:
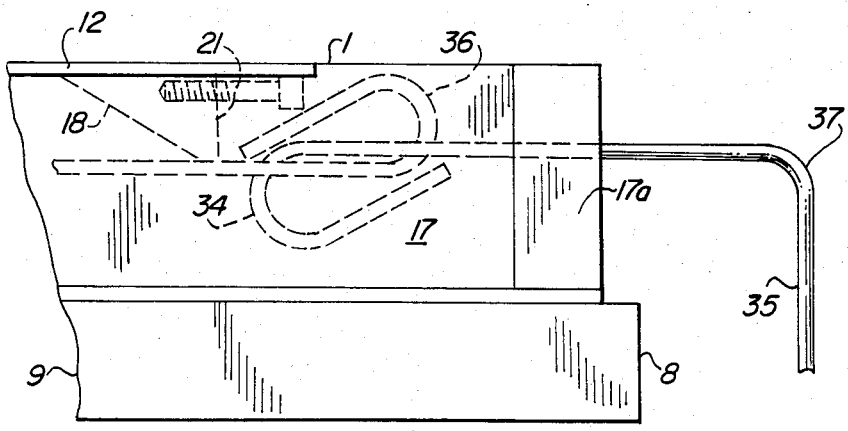
FIG. 6 is a fragmentary, detail side elevational view, similar to FIG. 4, but showing a later subsequent step in a tie joining operation.
Figure 7:
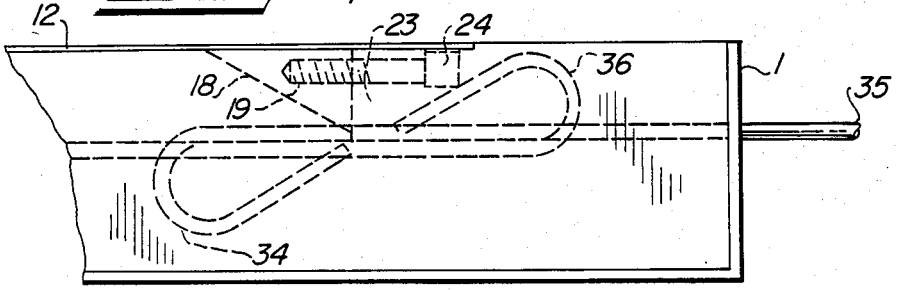
FIG. 7 is a fragmentary, detail side elevational view, similar to FIGS. 4 and 6, but showing a later subsequent step in a tie joining operation.

The natural resiliency of the bale tie wire 35, and the forward pulling thereof through the press 2 causes the trailing end portion 36 of the tie 35 to rise in the joiner 1 and be thus snaggingly engaged with the anchor 18 and lip portion 27 thereon. With the bend 37 thus formed in the tie 35, and with the main body portion of the leading end portion 34 disposed above the main body portion of the trailing end 36, as shown in FIGS. 6, 7 and 8, the portion of the tie 35 disposed forwardly of the bale 7 is pushed rearwardly to thereby push the looped leading end portion 34 into, as shown in FIG. 6, and through, as shown in FIG. 7, the looped trailing end portion 36 of the wire 5, this movement continuing until the portion of the wire 35 extending rearwardly from the bend 37 is closely adjacent to the front side of the bale 7. Such rearward movement of the leading portion 34 of the wire 35 may be accomplished by aiming the looped end 34 at the looped end 36, as shown in FIG. 5, and pushing the portions of the tie 35 extending rearwardly from the bend 37 up to the front face of the bale 7. In this movement, the looped end 34 separates the leading end of the trailing looped end 36 from the body of the wire 35, permitting the looped end 34 to pass through the looped end 36 into the position shown in FIGS. 7 and 8. The lip portion 27 of the anchor 18 is only as wide as the wire 35 which lies against the lower face thereof so that the looped leading end portion 34 is not snagged thereby as it passes the anchor 18.

Figure 9:
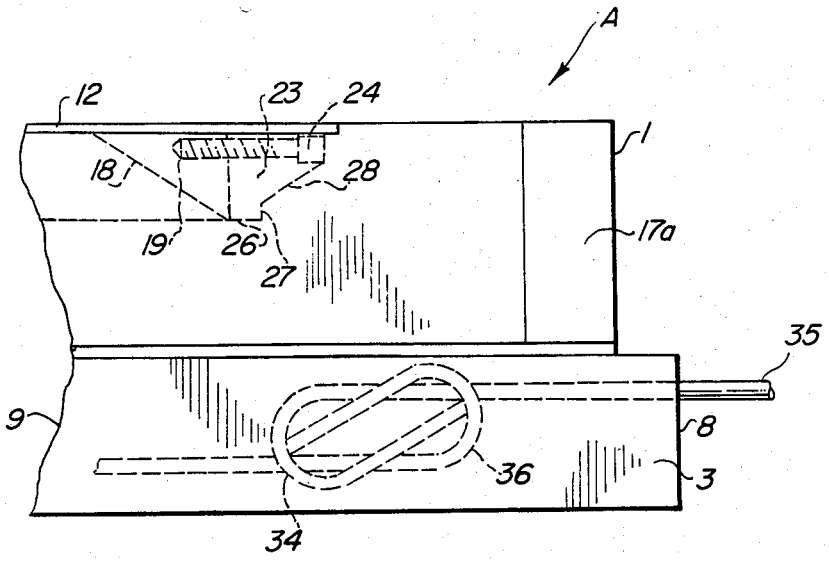
FIG. 9 is a fragmentary, detail side elevational view, similar to FIGS. 4, 6 and 7, but showing the tie ends in the position they are disposed upon completion of a joint or knot therebetween.

With the looped end portion 34 and 36 thus disposed relative to each other, the operator may now pull forwardly on the portion of the wire 35 disposed immediately rearwardly of the bend 37 and thus dispose the loop end portions 34 and 36 into the inter-twined, interlocking position shown in FIG. 9, the forward pulling of the wire 35 causing the thus formed knot or spliced joint to move downwardly upon the top of the bale 7, as shown in FIG. 9, in which position the joint is now visible to the operator through the passageway 32 in the joiner 1, along suitable line of sight, such as that indicated by the arrow or vector A, shown in FIG. 9.

It will be seen that with the splicer or joiner device 1 constructed and disposed in the press 2 in the above described manner, a press operator may readily line the end portions 34 and 36 for proper inter-engagement with each other, and may readily inspect the joint which was to have been made between the end portions 34 and 36 prior to releasing a press for bale ejection.

As will be appreciated by those skilled in the art, although the present disclosure is only of a single joining device, this is merely by way of illustration and not by way of limitation and a plurality of such joining devices may be afforded in a single press in side-by-side relation to each other without departing from the purview of the present invention.

From the foregoing it will be seen that the present invention affords a novel bale tie wire joiner.

Also, it will be seen that the present invention affords a novel bale tie joiner which is practical and efficient in operation and which may be readily and economically produced commercially.

Thus, while I have illustrated and described the preferred embodiment of my invention, it is to be understood that this is capable of variation and modification, and I therefore do not wish to be limited to the precise details set forth but desire to avail myself of such changes and alterations as fall within the purview of the following claims.

I claim:

1. A bale tie joining device comprising a. a housing having a pair of upstanding sidewalls spaced apart for defining an elongated passageway extending therethrough for the longitudinal passage of an elongated bale tie through said passageway from one end to the other end thereof, b. an anchor member positioned in said housing within said elongated passageway in spaced relation to said one end of said housing for engaging and holding the trailing end loop portion of such a bale tie during such passage of the latter through said passageway in position to be joiningly engaged by the other end portion of said bale tie, and c. said housing having an opening in the top thereof, between said anchor member and said one end of said passageway, for viewing the joined and engaged tie ends in said passageway from outside said housing when said engaged and joined tie ends have been released from said anchor member.

2. A bale tie joining device as defined in claim 1, and in which a. said anchor member comprises a downwardly and rearwardly sloping front wall facing toward said one end of said passageway and a lip portion projecting downwardly from the bottom of said front wall in position to snaggingly engage said trailing end portion of said bale tie during such longitudinal movement thereof through said passageway.

3. A bale tie joining device as defined in claim 2, and in which a. said bale tie end portions have loops formed therein, and b. said lip portion is substantially the same width, transversely to the length of the said passageway, as the body of said bale tie between said loops.

4. A bale tie joining device as defined in claim 3, and in which a. said anchor member is secured to the top of said housing in depending relation thereto, and terminates at its bottom in upwardly spaced relation to the bottom of said housing.

5. A bale tie joining device as defined in claim 4, and in which a. said loops on said tie ends are disposed in substantially vertically extending, parallel relation to each other during said joining of said tie end portions.

6. A bale tie joining device as defined in claim 5, and in which a. said loop on said trailing end portion of said tie snaggingly engages said lip during said passage of said tie through said passageway, and extends upwardly from said lip along said front wall of said anchor member during said joining engagement of said trailing end portion with said other end portion of said tie.

7. A bale tie joining device as defined in claim 6, and in which a. said loop on said other end portion of said tie is passed through said loop on said trailing end portion of said tie and then back into interlocking engagement with said last mentioned loop during said tie end joining.

8. A bale tie joining device in accordance with claim 1 wherein said pair of upstanding sidewalls further include inwardly beveled working surfaces to facilitate insertion of the bale tie into the joining device.

9. In a fiber press having upper and lower platens disposed between upper and lower follower blocks for compressing bales of fiber, with passageways extending through the platens, and a chute interconnecting the rear ends of said passageways so that an elongated bale tie may be fed rearwardly through the upper of said passageways, downwardly through said chute, and forwardly through the lower of said passageways, a bale tie joining device comprising a. an elongated housing mounted in said upper passageway in longitudinally extending relation thereto, b. said housing having a top wall and an anchor member mounted on and depending from said top wall in position to snaggingly engage and hold the trailing end portion of such a bale tie, during said passageway of said bale tie through said upper passageway, in position to be joiningly engaged by the other end portion of said bale tie on top of such a compressed bale, c. said anchor member being disposed in spaced relation to the entry end of said housing for such a tie, and d. said top wall having an opening extending downwardly therethrough, between said anchor member and said entry end of said housing, for viewing such joined and engaged tie ends in said housing when said engaged and joined tie ends have been moved downwardly from said anchor member.

* * * * *

UNITED STATES PATENT AND TRADEMARK OFFICE

CERTIFICATE OF CORRECTION

PATENT NO. : 4,509,416

DATED : April 9, 1985

INVENTOR(S) : Emil Simich

It is certified that error appears in the above—identified patent and that said Letters Patent is hereby corrected as shown below:

Column 3, line 40, after "bale" insert --tie--.

Signed and Sealed this

*Twenty-third* Day of *July 1985*

[SEAL]

*Attest:*

DONALD J. QUIGG

*Attesting Officer* *Acting Commissioner of Patents and Trademarks*